United States Patent [19]

Murray

[11] 4,245,625

[45] Jan. 20, 1981

[54] AIR-ACTIVATED WATER AGITATOR FOR HYDROTHERAPY TREATMENTS

[76] Inventor: William M. Murray, 306 N. Front St., Liverpool, Pa. 17045

[21] Appl. No.: 33,809

[22] Filed: Apr. 26, 1979

[51] Int. Cl.[3] ..... A61H 9/00

[52] U.S. Cl. ..... 128/66

[58] Field of Search ..... 128/65, 66; 4/180

[56] References Cited

U.S. PATENT DOCUMENTS

| | | | |
|---|---|---|---|
| 1,034,919 | 8/1912 | Leuschner | 4/180 |
| 3,043,296 | 7/1962 | Gregory | 128/66 |
| 3,138,153 | 6/1964 | Osborn et al. | 128/66 |
| 3,373,740 | 3/1968 | Riepl | 128/66 |
| 3,533,404 | 10/1970 | Labarber | 128/66 |

*Primary Examiner*—Lawrence W. Trapp
*Attorney, Agent, or Firm*—Maky, Renner, Otto & Boisselle

[57] ABSTRACT

An air-activated water agitator for hydrotherapy treatments comprises an elongate, flexible conduit having a series of jet openings at intervals along its length and a coupling for connecting the conduit with a source of pressurized air such as a common household vacuum cleaner. The agitator advantageously provides maximum patient stimulation by permitting equalized pressurized air streams to be introduced into the water from all sides of the tank or from a localized portion of the tank without requiring potentially dangerous electrical devices to be in or near the water.

15 Claims, 5 Drawing Figures

AIR-ACTIVATED WATER AGITATOR FOR HYDROTHERAPY TREATMENTS

FIELD OF THE INVENTION

This invention relates to an apparatus for use in hydrotherapeutic treatment of a patient, and more particularly to an air activated water agitator.

BACKGROUND OF THE INVENTION

Hydrotherapy is the treatment of diseases or ailments of patients by the external use of water or other fluids. In hydrotherapeutic treatments, agitation of a fluid bath is often desired to effect massage and/or stimulation of that portion of the patient's body submerged in the bath. Such hydrotherapeutic treatments may be used, for example, to treat or provide relief from various back or muscle ailments afflicting the patient.

The patient first may be exposed to hydrotherapy in a hospital or similar institution where hydrotherapeutic treatments may be prescribed by the patient's attending physician and conducted on a regular basis. Equipment employed in some hospitals is known to consist of a large tank containing water which is agitated by large pumps mounted at each end of the tank. The patient is then suspended on a litter and lowered into the tub for treatment.

After the patient is discharged from the hospital, continuation of the hydrotherapeutic treatments may still be desirable. However, the equipment needed to conduct the treatments such as employed in the hospital generally is not readily available for home use principally because of its size and expense and the need for attendants to assist the patient. Therefore, the patient may be faced with the decision either to discontinue treatments or to travel to the hospital for treatment on an outpatient basis.

Other equipment is known which creates a whirlpool effect in a water bath and some forms of such equipment may be used in conjunction with conventional home bathtubs. Such equipment normally comprises an electric motor encased in a suitable housing which is adapted to be placed or mounted on the edge of a bathtub with a pump or nozzle end extending into the water for agitation of the same. One drawback with such equipment is that the electric components thereof being in close proximity to the water present the possibility of injury to the patient by electrocution. Another drawback of such equipment is that uniform agitation of the water in the bathtub is not provided because generation of the agitation occurs only in one location, i.e., at the nozzle end, with the intensity of agitation diminishing as the distance from the nozzle end increases. Moreover, such devices, although not as expensive as those employed in hospitals, are still costly.

In using this equipment for the lengthy treatment time normally required, the temperature of the water contained in the tub or tank will steadily drop and will reach a point which is uncomfortable to the patient. It is, therefore, desirable to provide for heating the water in the tub while agitating the same. Moreover, it is desirable to heat the water without introducing electrical heating elements into or in close proximity to the water.

OBJECTS OF THE INVENTION

With the foregoing in mind, it is a principal object of the present invention to provide a hydrotherapeutic apparatus for agitation of water or other fluids which is inexpensive and which can be used in conjunction with a common household bathtub.

Another important object of the invention is to provide such an apparatus which is air activated and provides for equalized pressure distribution throughout the tub or tank in which the same is mounted.

Still another object of the present invention is to provide such an apparatus which is relatively compact when stored.

Yet another object of the invention is to provide such an apparatus which is adjustable in use to provide for maximum patient stimulation in desired body localities.

A further important object of the invention is to provide such an apparatus which eliminates the need for electrical devices or components in close proximity to the water being agitated.

Still a further object of the invention is to provide such an apparatus which employs or can be utilized with common household appliances which provide the necessary motive force for effecting agitation of the water.

Yet a further object of the invention is to provide such an apparatus having provision for uniformly heating the water during agitation of the same.

Still yet a further object of the invention is to provide such an apparatus which is easy and inexpensive to manufacture and is highly durable in use.

SUMMARY OF THE INVENTION

To the achievement of the foregoing objects and other objects that will become apparent as the following description proceeds, this invention provides a hydrotherapeutical apparatus for air activated agitation of a liquid bath for hydrotherapeutic treatment of a patient which apparatus comprises an elongate flexible tubular member having a series of jet openings at intervals along its length and means for connecting the tubular member with a source of pressurized air. A preferred tubular member is a flexible rubber or plastic hose and the jet openings are alternately arranged laterally and upwardly in a predetermined pattern along the length of the hose to obtain desired and effective agitation of the liquid bath.

According to a preferred form of the invention, the ends of the tubular member are connected to a common suitable coupling provided for attaching the same to a conventional household appliance, such as a vacuum cleaner. Such appliance supplies pressurized air to the tubular member in its assembled endless configuration, which air exits through the jet openings in the tubular member with substantial velocity for agitation of the water. Such coupling comprises a large diameter fitting end adapted to be connected to the hose of a conventional vacuum cleaner and reduced diameter arm portions adapted for connection to end fittings provided at the ends of the elongate flexible tubular member.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DESCRIPTION OF THE PREFERRED EMBODIMENT

Figure 1:
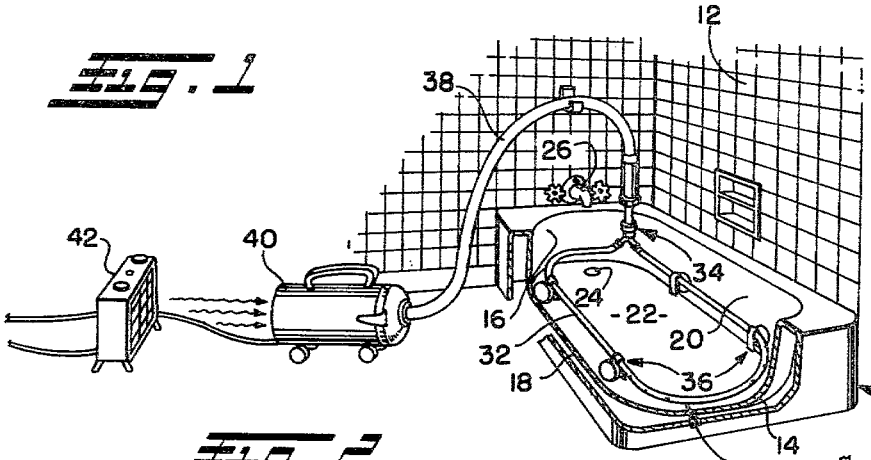
FIG. 1 is a perspective view, partially broken away, illustrating a conventional bathtub in which the hydrotherapeutic apparatus according to the present invention is employed.

Referring now in greater detail to the drawings, FIG. 1 shows a conventional bathroom setting including a bathtub 10 positioned against bathroom walls 12. The bathtub may be of a conventional modern type having opposite head and foot vertical end walls 14 and 16, respectively, interconnected by opposite vertical side walls 18 and 20. The lower marginal portions of the walls 14, 16, 18 and 20 are commonly curved inwardly and interconnected by bottom wall 22 which normally is inclined downwardly from head end wall 14 to the foot end wall 16. A drain 24 is provided at the lowermost extent of the bottom wall 22 adjacent the foot end wall 16 and is operable by suitable means to drain the bathtub 10. Water is supplied to the tub from tap 26 projecting from the wall 12 and the volume of cold and/or hot water passing through the tap is regulated in customary fashion by valve controls which also project from the wall 12. Such bathtub 10 is normally sized to accommodate an average adult person and is of sufficient length to allow such person to lay substantially in a prone position generally with the back of the person resting on the bottom wall 22 of the tub and with the head of the person resting against the head end wall 14. The head end wall 14 of the tub usually is gradually inwardly sloped from the upper marginal edge thereof to its lower marginal edge to provide a comfortable support surface for the shoulders and head of a person lying in the prone position.

In accordance with the present invention, agitation of the water or other fluid contained in the tub 10 may be obtained by employing the hydrotherapeutic apparatus designated generally by reference 30. Such apparatus 30 includes an elongate, flexible tubular member or conduit such as a flexible hose 32 which is connected at its respective ends to two arms of a Y-shape coupling 34 by suitable fittings whereby the hose 32 is formed essentially into an endless loop. The hose 32 has formed therein a series of jet openings along the length thereof which are arranged in a pattern described below in greater detail. The hose 32 may be mounted in the tub by mounts 36. As shown, there are four such mounts 36 provided for mounting the hose to the side walls 18 and 20 adjacent their head and foot ends so that the hose 32 is maintained in a configuration substantially circumscribing the interior of the tub and spaced slightly above the bottom wall 22.

For agitation of the water by the apparatus 30, the enlarged diameter fitting of Y-shape coupling 34 is connected by a hose 38 to a source of pressurized air, such as to a conventional household vacuum cleaner 40. The hose 38 of course is connected to the vacuum cleaner at its outlet or exhaust port. In this manner, air under pressure is sequentially forced through the hose 38, coupling 34 and hose 32. The pressurized air then exits through the jet openings in small high-pressure jets for agitating the liquid in the bathtub 10. If desired, a source of heat such as electric heater 42 may be positioned near the inlet or suction port of the vacuum cleaner 40 for heating the supply air to the vacuum cleaner, which heated air is discharged into the water contained in the tub to warm the same.

Figure 2:
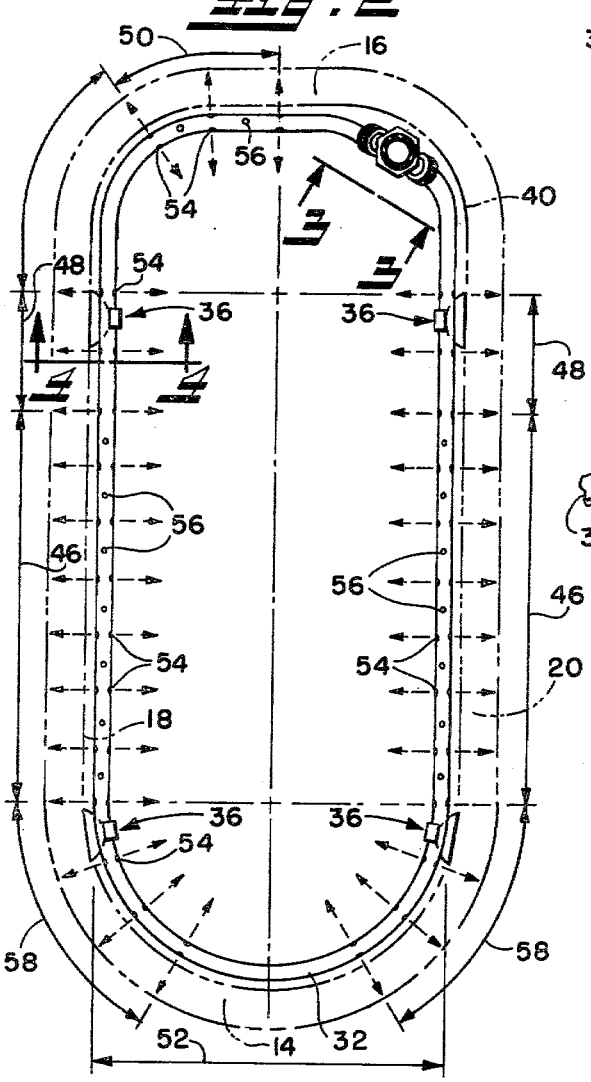
FIG. 2 is a plan view of the bathtub portion of the apparatus shown in FIG. 1.

Referring now to FIG. 2, the arrangement of the jet openings for effecting desired agitation of the water in the liquid bath can be best seen. For descriptive purposes, the hose 32 may be divided up into portions corresponding generally to the side walls of the tub when positioned therein substantially circumscribing the interior of the tub. The hose 32 may include upper and lower body side portions 46 and 48, respectively, adjacent to the tub side walls 18 and 20, foot portion 50 adjacent the tub end wall 16, and head portion 52 adjacent the tub end wall 14. The upper body portions 46 and foot portions 50 of the hose may have formed therein opposed horizontal jet openings 54 and opposed vertical jet openings 56, such horizontal and vertical openings preferably being alternately arranged at equally spaced longitudinal intervals, such as about three inch intervals, for uniform agitation of the water in those areas generally occupied by the upper body and feet of the patient lying prone in the tub. The head portion 52, however, may have only opposed horizontal jet openings 54 arranged at the end sections 58 thereof adjacent the side portions 46 with no openings in the section intermediate the end sections 58. The lower body portions 48 may also have only horizontal jets 54.

Figure 3:
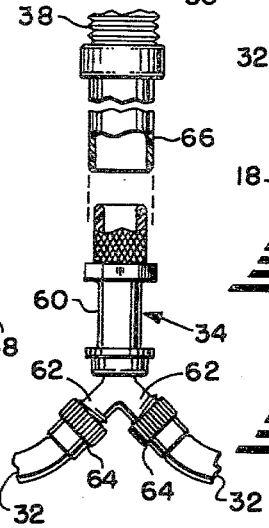
FIG. 3 is an enlarged elevation of the Y-shape coupling for the hydrotherapeutic apparatus as taken along the line 3—3 in FIG. 2, with portions of the large diameter fitting and of the coupling being shown in section.

Referring now to FIG. 3, the preferred Y-shape coupling 34 includes an enlarged diameter stem 60 and two smaller diameter arms 62 extending from the stem preferably at a right angle to each other. Each arm 62 at its distal end is threaded to receive therein in threaded engagement a hose fitting 64 at each end of the hose 32. The stem 60 comprises a tubular section preferably twice greater in interior cross-section than the arms 62, and is adapted to have connected thereto the end fitting 66 of the vacuum cleaner hose 40 for supplying pressurized air therethrough.

Figure 4:
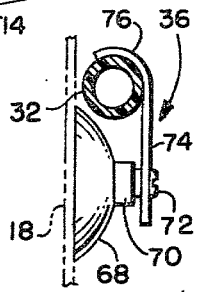
FIG. 4 is an enlarged elevation, partially in section, taken along the line 4—4 of FIG. 2 showing a mounting mechanism selectively for securing the tubular member to the side of the bathtub.

In FIG. 4, the preferred mount 36 can be seen to comprise a suction cup 68 of conventional type having a centrally located boss 70. The boss 70 has therein a threaded bore for receipt of a threaded fastener 72, the shank of which extends through an opening in one end of a mounting strap 74 so that the head of the fastener clamps the mounting strap to the suction cup 68. The other end of the mounting strap is curved as indicated at 76 to conform generally to the exterior of the hose and the hose may be secured to the curved end 76 of the strap 74 by a suitable adhesive. Alternatively, if an adhesive or other securing means is not employed, the curved end 76 by partially surrounding the hose will serve to retain the hose between the same and the tub side wall to which the anchor is secured while allowing the hose to be adjusted longitudinally relative to the anchors, and to permit removal of the anchor from the hose if desired.

Figure 5:
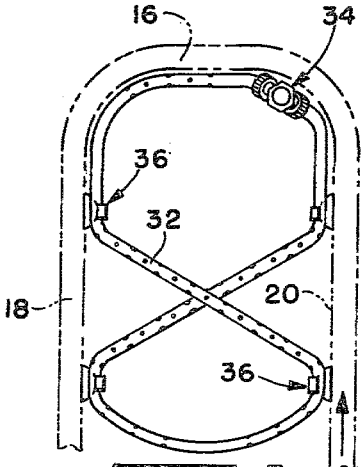
FIG. 5 is a reduced plan view of the apparatus of FIG. 2 with the same adjustably arranged in another position for localized agitation of a portion of the water in the tub.

Although the device is shown in FIGS. 1 and 2 as it would normally be employed in a bathtub 10 for general hydrotherapeutic treatment purposes, an important aspect of the invention is that the flexible hose 32 may be adjusted to assume any number of positions and configurations for maximum localized stimulation of selected portions of a patient's body as required. For example, FIG. 5 shows the hose arranged in a "FIG. 8" pattern for treatment of a tired back. Another arrangement would be to form a double loop in the foot portion of the tub 10 for localized treatment of the feet and legs of a patient.

In view of the foregoing, it can now be appreciated that the air powered adjustable device 30 advantageously provides for maximum patient stimulation by permitting pressurized air streams to be introduced into a fluid bath for uniform agitation of the entire bath or a localized portion thereof without requiring potentially dangerous electrical devices to be in or near the water.

Although the device has been shown and described in connection with a conventional bathtub, it should be understood that the apparatus 30 may be used with other types of tanks or tubs of different sizes and dimensions, as well as with liquids other than water. Moreover, it is obvious that equivalent alterations and modifications will occur to others skilled in the art upon the reading and understanding of the specification and description of the preferred embodiment. The present invention includes all such equivalent alterations and modifications and is limited only by the scope of the appended claims.

What is claimed is:

1. A device for air-agitation of a liquid contained in a tub for hydrotherapeutic treatment of a patient, comprising: an elongate, flexible conduit having a series of jet openings therein at intervals along its length, means for connecting said conduit with a source of pressurized air, a plurality of suction cups for mounting said conduit in the tub, and means for adjustably connecting said conduit to said suction cups along the length of said conduit.

2. The device as set forth in claim 1 wherein at least a plurality of said jet openings are alternately arranged horizontally and vertically along a portion of the length of the said conduit.

3. The device as set forth in claim 2 wherein said conduit comprises a tubular hose.

4. A device for air-agitation of a liquid contained in a tub for hydrotherapeutic treatment of a patient, comprising: an elongate, flexible conduit having a series of jet openings therein at intervals along its length, means for connecting said conduit with a source of pressurized air, at least a plurality of said jet openings being alternately arranged horizontally and vertically along a portion of the length of said conduit, said conduit including a tubular hose, and mounting means for mounting said hose in the tub, said mounting means including a plurality of suction cups and means for connecting said hose to said suction cups at spaced intervals along the length thereof, said means for connecting including a support strip curved at one end with a radius about equal the radius of said hose and means for securing said support strip at its other end to said suction cup.

5. The device as set forth in claim 4 wherein the curved end of the support strip at least partially surrounds said hose, and means for securing said strip at its curved end to said hose.

6. The device as set forth in claim 4 wherein said curved end partially surrounds said hose and is movable longitudinally along said hose to vary the longitudinal spacing between adjacent mounting means.

7. The device as set forth in claim 1 wherein said conduit has respective ends, and said means for connecting comprises a Y-shape coupling having stem and arm portions, said ends being connected to said arm portions, respectively.

8. The device as set forth in claim 7 wherein said stem has an inlet end and said arms have outlet ends, said inlet end having a greater cross-sectional area than said outlet ends.

9. The device as set forth in claim 8 wherein said stem and said arms have a cross-sectional area less than that at said inlet end.

10. The device as set forth in claim 1 wherein at least a plurality of said jet openings are arranged horizontally and vertically at spaced intervals.

11. The device as set forth in claim 7 wherein said means for connecting comprises a coupling connected to the end of a vacuum hose.

12. The device as set forth in claim 11 wherein said source of pressurized air comprises a vacuum cleaner having an air inlet and outlet, with the vacuum hose being connected to said outlet at one end and to said coupling at its other end.

13. The device as set forth in claim 1 comprising heater means positioned adjacent said air inlet of the vacuum cleaner to heat the air sucked into said inlet.

14. The device as set forth in claim 1 wherein the source of pressurized air comprises a vacuum cleaner and wherein the device further comprises a heater means for heating the air delivered to said vacuum cleaner.

15. In combination, a tub including a bottom, vertical side walls and end walls to contain a liquid, and a device for agitating such liquid for hydrotherapy treatments of a patient resting in the tub, said device comprising an endless air conduit extending along the tub walls and including a series of jet openings, said jet openings adjacent the side walls being alternately arranged horizontally and vertically at spaced intervals and said jet openings adjacent one of said end walls being arranged horizontally and adjacent the other being arranged horizontally and vertically, and means for supplying pressurized air to said air conduit.

* * * * *